US006876330B2

(12) United States Patent
Alexeff et al.

(10) Patent No.: US 6,876,330 B2
(45) Date of Patent: Apr. 5, 2005

(54) RECONFIGURABLE ANTENNAS

(75) Inventors: Igor Alexeff, Oak Ridge, TN (US); Theodore Anderson, Brookfield, MA (US); Elwood G. Norris, Poway, CA (US)

(73) Assignee: Markland Technologies, Inc., Ridgefield, CT (US)

( * ) Notice: Subject to any disclaimer, the term of this patent is extended or adjusted under 35 U.S.C. 154(b) by 0 days.

(21) Appl. No.: 10/621,266

(22) Filed: Jul. 16, 2003

(65) Prior Publication Data

US 2004/0130497 A1 Jul. 8, 2004

Related U.S. Application Data

(60) Provisional application No. 60/396,641, filed on Jul. 17, 2002.

(51) Int. Cl.[7] ..... H01Q 1/26
(52) U.S. Cl. ..... 343/701; 343/725
(58) Field of Search ..... 343/701, 725, 343/785, 786, 895, 900

(56) References Cited

U.S. PATENT DOCUMENTS

| | | | | |
|---|---|---|---|---|
| 2,641,702 A | | 6/1953 | Cohen et al. | 250/33.63 |
| 2,643,297 A | | 6/1953 | Goldstein et al. | 178/44 |
| 3,155,924 A | | 11/1964 | Kaufman et al. | 333/7 |
| 3,212,034 A | | 10/1965 | Kaufman et al. | 333/73 |
| 3,238,531 A | | 3/1966 | Kaufman et al. | 343/701 |
| 3,404,403 A | | 10/1968 | Vallese et al. | 343/700 |
| 3,508,268 A | | 4/1970 | Forman | 343/701 |
| 3,634,767 A | | 1/1972 | Roeder et al. | 325/363 |
| 3,719,829 A | | 3/1973 | Vaill | 307/149 |
| 3,779,864 A | | 12/1973 | Kaw et al. | 176/1 |
| 3,914,766 A | | 10/1975 | Moore | 343/701 |
| 4,001,834 A | | 1/1977 | Smith | 343/754 |
| 4,028,707 A | | 6/1977 | Young et al. | 343/719 |
| 4,062,010 A | | 12/1977 | Young et al. | 343/5 NA |
| 4,473,736 A | | 9/1984 | Bloyet et al. | 219/121 PM |
| 4,574,288 A | | 3/1986 | Sillard et al. | 343/781 P |
| 4,611,108 A | | 9/1986 | Leprince et al. | 219/121 PR |
| 4,792,732 A | * | 12/1988 | O'Loughlin | 315/334 |
| 4,989,013 A | | 1/1991 | Smith, II et al. | 343/721 |
| 5,003,514 A | | 3/1991 | Cotilla et al. | 367/4 |
| 5,175,560 A | | 12/1992 | Lucas et al. | 343/767 |
| 5,546,096 A | | 8/1996 | Wada | 343/771 |
| 5,594,456 A | | 1/1997 | Norris et al. | 343/701 |
| 5,734,353 A | | 3/1998 | Van Voorhies | 343/742 |
| 5,923,116 A | * | 7/1999 | Mercer et al. | 313/113 |
| 5,963,169 A | | 10/1999 | Anderson et al. | 343/701 |
| 5,984,385 A | | 11/1999 | Shtarkman et al. | 292/251.5 |
| 5,990,837 A | | 11/1999 | Norris et al. | 343/701 |
| 5,990,851 A | | 11/1999 | Henderson et al. | 343/915 |
| 6,046,705 A | | 4/2000 | Anderson | 343/834 |
| 6,087,992 A | | 7/2000 | Anderson | 343/701 |
| 6,087,993 A | | 7/2000 | Anderson et al. | 343/701 |
| 6,115,003 A | | 9/2000 | Kozakoff | 343/840 |
| 6,118,407 A | | 9/2000 | Anderson | 343/701 |
| 6,169,520 B1 | | 1/2001 | Anderson | 343/701 |
| 6,369,763 B1 | | 4/2002 | Norris et al. | 343/701 |
| 6,512,496 B2 | | 1/2003 | Alexeff et al. | 343/915 |
| 6,624,719 B1 | | 9/2003 | Anderson et al. | 333/99 PL |

FOREIGN PATENT DOCUMENTS

| | | |
|---|---|---|
| WO | WO00/21156 | 4/2000 |

* cited by examiner

*Primary Examiner*—Shih-Chao Chen
(74) *Attorney, Agent, or Firm*—Thorpe North & Western, LLP

(57) ABSTRACT

An antenna element comprising at least two conductive elements, and a fluid (e.g., gas or vapor) filled bulb or tube positioned between the conductive elements is provided. The fluid is capable of ionization such that when the fluid in the bulb or tube is energized, the conductive elements electrically communicate with one another, and when the fluid is not energized, the conductive elements do not electrically communicate with one another.

20 Claims, 3 Drawing Sheets

RECONFIGURABLE ANTENNAS

The present application claims priority to Provisional U.S. Patent Application No. 60/396,641 filed Jul. 17, 2002, which is incorporated herein by reference in its entirety.

FIELD OF THE INVENTION

The present invention is drawn to reconfigurable antennas. More specifically, the present invention is drawn to antennas that can reconfigured by the use of gas filled bulbs.

BACKGROUND OF THE INVENTION

Traditionally, antennas have been defined as metallic devices for radiating or receiving radio waves. Therefore, the paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from the general broadcast of RF signals to weapon systems of a highly complex nature.

Conductive wire antennas are generally sized to emit radiation at one or more selected frequencies. To maximize effective radiation of such energy, the antenna is adjusted in length to correspond to a resonating multiplier of the wavelength of frequency to be transmitted. Accordingly, typical antenna configurations will be represented by quarter, half, and full wavelengths of the desired frequency.

Efficient transfer of RF energy is achieved when the maximum amount of signal strength sent to the antenna is expended into the propagated wave, and not wasted in antenna reflection. This efficient transfer occurs when the antenna length is an appreciable fraction of transmitted frequency wavelength. The antenna will then resonate with RF radiation at some multiple of the length of the antenna. Due to this traditional length requirement, rigid metal antennas can be somewhat limited in breadth as to the frequency bands that they may radiate or receive.

SUMMARY OF THE INVENTION

It has been recognized that it would be advantageous to develop antennas that are reconfigurable with respect to length, radiation pattern, beam width, band width, and other known antenna radiation properties. The present invention is drawn to an antenna, comprising at least two conductive elements and a fluid filled bulb. The at least two conductive elements can include a first conductive element having a different configuration than a second conductive element. The fluid filled bulb can be positioned between the at least two conductive elements such that when the fluid filled bulb is energized, the at least two conductive elements electrically communicate with one another, and when the fluid filled bulb is not energized, the at least two conductive elements do not electrically communicate with one another.

In another embodiment, an electromagnetic wave transmission and reception system can comprise a first conductive element and a second conductive element, a transmitter/receiver, and a first and second fluid filled bulb. The transmitter/receiver can be configured for sending and receiving a signal to and from the first and second conductive elements. The first fluid filled bulb can be positioned between the first conductive element and the transmitter/receiver such that when the first fluid filled bulb is energized, the first conductive element and the transmitter/receiver electrically communicate with one another, and when the first fluid filled bulb is not energized, the first conductive element and the transmitter/receiver do not electrically communicate with one another. The second fluid filled bulb can be positioned between the second conductive element and the transmitter/receiver such that when the second fluid filled bulb is energized, the second conductive element and the transmitter/receiver electrically communicate with one another, and when the second fluid filled bulb is not energized, the second conductive element and the transmitter/receiver do not electrically communicate with one another.

In another embodiment, an antenna can comprise at least two conductive elements including a first conductive element and a second conductive element, and a fluid filled bulb. The first conductive element can be configured to emit a first radiation pattern. The fluid filled bulb can be positioned between the at least two conductive elements such that when the fluid filled bulb is energized, the at least two conductive elements electrically communicate with one another and synergistically form a second radiation pattern that is different than the first radiation pattern. When the fluid filled bulb is not energized, the at least two conductive elements do not electrically communicate with one another.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

A more complete understanding of the invention will be readily appreciated by reference to the following detailed description when considered in conjunction with the accompanying drawings. Corresponding reference characters indicate corresponding parts throughout the several embodiments shown.

DETAILED DESCRIPTION OF THE INVENTION

Figure 1:
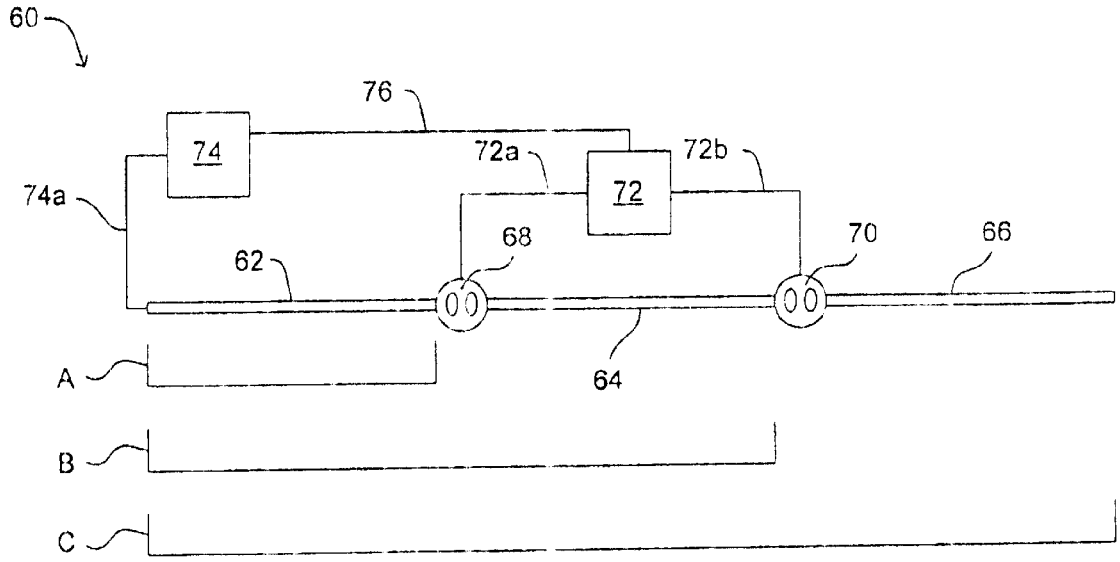
FIGS. 1 and 2 illustrate a schematic representation of an antenna element comprised of conductive elements joined by fluid, e.g., gas or vapor, filled bulbs or tubes wherein the fluid is capable of ionization.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Figure 2:
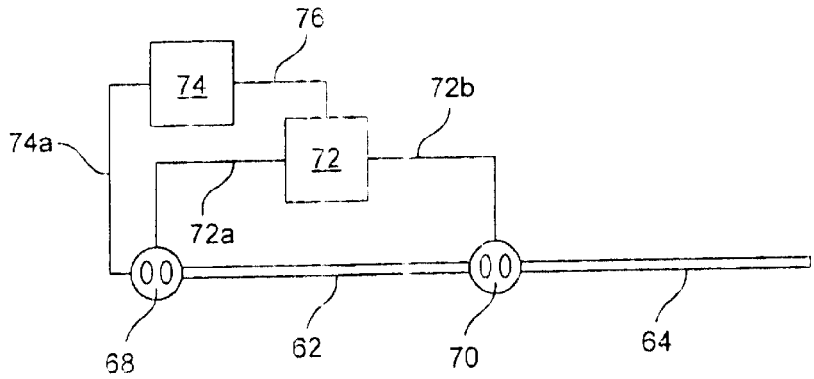

Referring to FIGS. 1 and 2, combinations of conductive elements and a fluid filled bulbs or tubes are shown. In FIG. 1, three conductive elements 62,64,66 can be used for antenna transmission or reception. These conductive elements 62,64,66, which can be flexible or pivotable metallic structures, plasma elements, or combination thereof, are connected by two ionizable fluid filled bulbs 68,70. The term "bulbs" does not infer any specific shape that can be used, as any functional shaped of dielectric material that can contain an ionizable gas can be used. Thus, any number of conductive elements 62,64,66 and fluid filled bulbs 68,70 can be used. When the fluid bulbs 68,70 are energized, the fluid becomes ionized and the conductive elements 62,64,66 become electrically coupled, thereby forming an elongated antenna element. The conductive elements 62,64,66 can be wire-like, plate-like, plasma antennas, or any other structure known for use in the field of antenna reception and transmission. A bulb energizer 72 is used to energize appropriate fluid filled bulbs 68,70 at appropriate times and locations. The bulb energizer 72 can be electrically coupled to the fluid filled bulbs 68,70 by energizer leads 72*a*,72*b* or by any other known method. Additionally, a transmitter and/or receiver device 74 can be connected to any or all of the conductive elements 62,64,66 or fluid filled bulbs 68,70 as is desired. However, in the embodiment shown in FIG. 1, the transmitter/receiver 74 is electromagnetically coupled to conductive element 62 by a conductive lead 74*a*. Additionally, an electrical communication line 76 can be present between the bulb energizer 72 and the transmitter/receiver 74 in situations where it is desirable for one of the units to control the other.

Essentially, when fluid filled bulbs 68,70 are turned off by the bulb energizer 72, conductive element 62 alone acts as active antenna A. If fluid filled bulb 68 is energized and fluid filled bulb 70 is turned off, then the active antenna element becomes active antenna B, which is comprised of conductive element 62, fluid filled bulb 68, and conductive element 64. When both fluid filled bulbs 68,70 are energized, active antenna C is formed.

If the desire is to provide an antenna that is not activated at all until at least one fluid filled bulb is energized, then a fluid filled bulb can be placed between any of the conductive elements and the transmitter/receiver 74. Such an embodiment is shown if FIG. 2. In this embodiment, the conductive lead 74*a* couples the transmitter/receiver 74 to a fluid filled bulb 68. Thus, when fluid filled bulb 68 is not energized, no antenna is active with respect to the transmitter/receiver 74. This arrangement can be used when it is desired to electrically isolate the antenna from the antenna transmitter/receiver, such as in cases where protection from electronic warfare may be desirable, for example.

In either embodiment, it can be desirable that the fluid filled bulb antenna element be flexible, pivotal, retractable, bendable, or contain some other property or configuration that allows for retraction and expansion in accordance with the present invention. Exemplary gases that can be ionized to form a conductive path between conductive elements can include argon, neon, helium, krypton, xenon, and hydrogen. Additionally, metal vapors capable of ionization such as mercury vapor can also be used.

Figure 3:
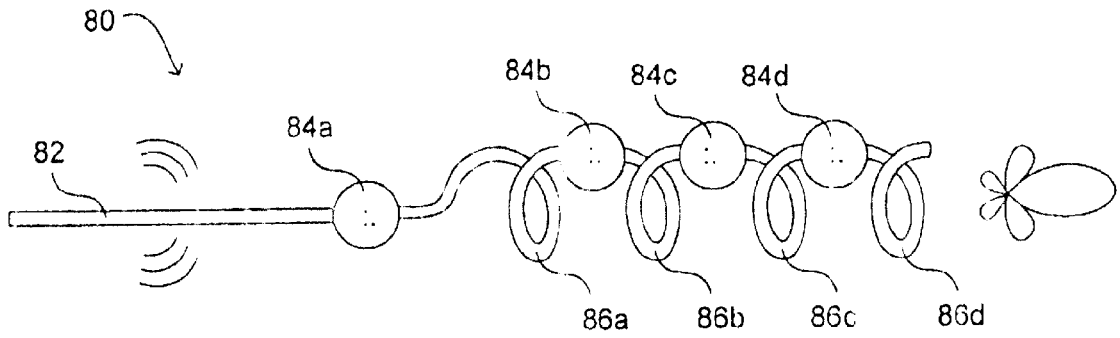
FIG. 3 is a schematic representation of a linear/helical antenna hybrid system joined by fluid filled bulbs or tubes, wherein the fluid is capable of ionization.

Referring to FIG. 3, a variation of the antennas provided by FIGS. 1 and 2 is provided. Specifically, system 80 comprises a linear antenna element 82 electromagnetically connected to a helical antenna 86*a–d* when gas filled bulb 84*a* is energized to form a plasma. In other words, as in FIGS. 1 and 2, the fluid filled bulb 84*a* can be turned on or turned off. Thus, two different types of antenna elements can be connected to work in concert. For example, if an omnidirectional signal is desired for broadcast, or if receiving of a signal is desired, then the fluid filled bulb 84*a* can be configured to be in a non-energized state, and thus, the linear antenna 82 will not communicate with the helical antenna 86*a–d*. However, if the fluid filled bulb 84*a* is energized to form a plasma within the bulb, then the linear antenna element 82 and the helical antenna 86*a–d* can communicate.

Also shown in system 80 is a plurality of fluid filled bulbs 84*b–d* which are present to provide reconfigurability to the helical antenna 86*a–d* itself. For example, by energizing fluid filled bulb 84*b* such that a plasma is formed within the bulb, section 86*a* and 86*b* of the helical antenna can communicate, providing a helical antenna segment that has two complete turns. If the fluid of fluid filled bulbs 84*b–c* are energized, then a helical antenna element having three turns will effectively be present. If the fluid of fluid filled bulbs 84*b–d* are all energized, then a helical antenna element having four turns will effectively be present. By altering the number of turns, the beam width can be reconfigured when firing in the axial mode. For example, the beam width can be different when 6 turns are present compared to 8 turns, etc. In the embodiment shown, from 0 to 4 turns is possible, though this number can be modified to as many turns as desirable and practical. Additionally, the linear antenna portion is not necessary to utilize the helical portion of the antenna system shown. They are shown together as part of a system, but could easily be split into two separate antenna systems as would be apparent to one skilled in the art after reading the present disclosure. For example, a signal generator (not shown) can be connected directly to the helical antenna portion of the system.

Figure 4:
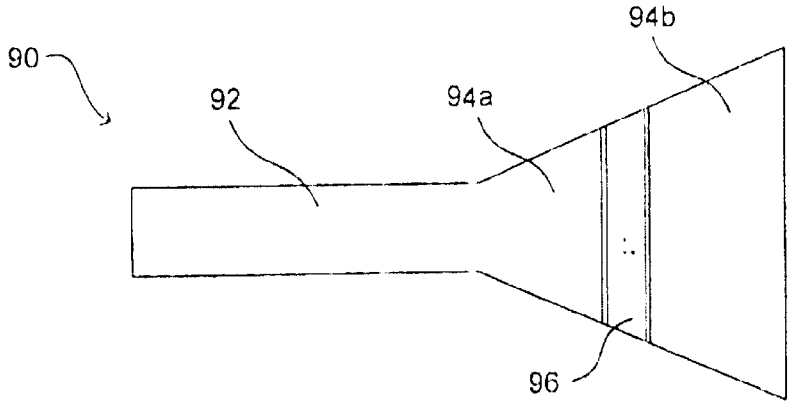
FIGS. 4 and 5 provide a schematic representation of a waveguide/horn antenna wherein the horn is reconfigurable via a fluid filled chamber or bulb.
Figure 5:
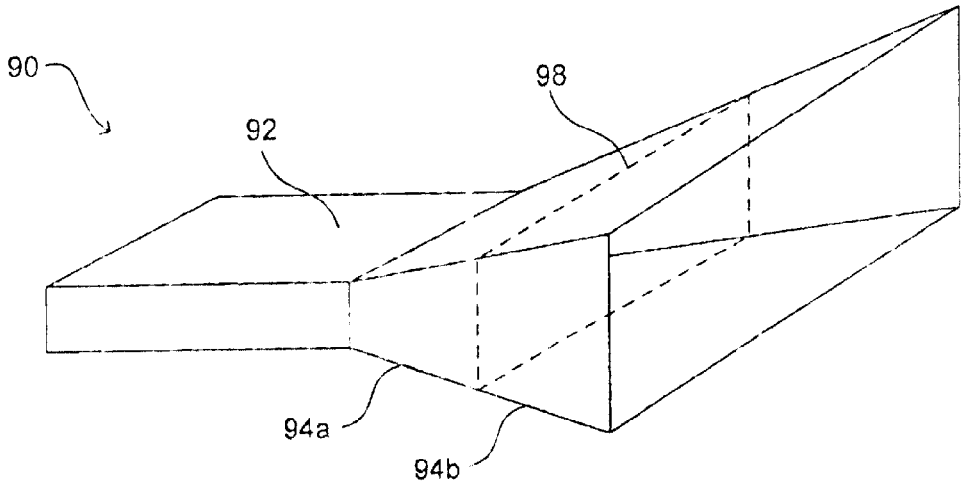

Turning now to FIGS. 4 and 5, an aperture antenna system 90 is shown that comprises a waveguide portion 92, a horn portion 94*a*, 94*b*, and a gas filled bulb 96 to reconfigure the length of a horn portion 94*a*, 94*b*. By energizing the fluid within fluid filed bulb or chamber 96 to form a plasma, the entire horn portion 94*a*, 94*b* can be utilized. However, if the fluid is not energized, then the non-conductive gap provides a discontinuity such that only a portion of the horn 94*a* will be substantially functional. By reconfiguring the horn in this manner, the radiation pattern can be reconfigured. FIG. 5 provides a perspective view depicting one possible general location 98 of the fluid filled bulb(s) with respect to the horn portion 94*a*, 94*b* of the aperture antenna system 90.

Figure 6:
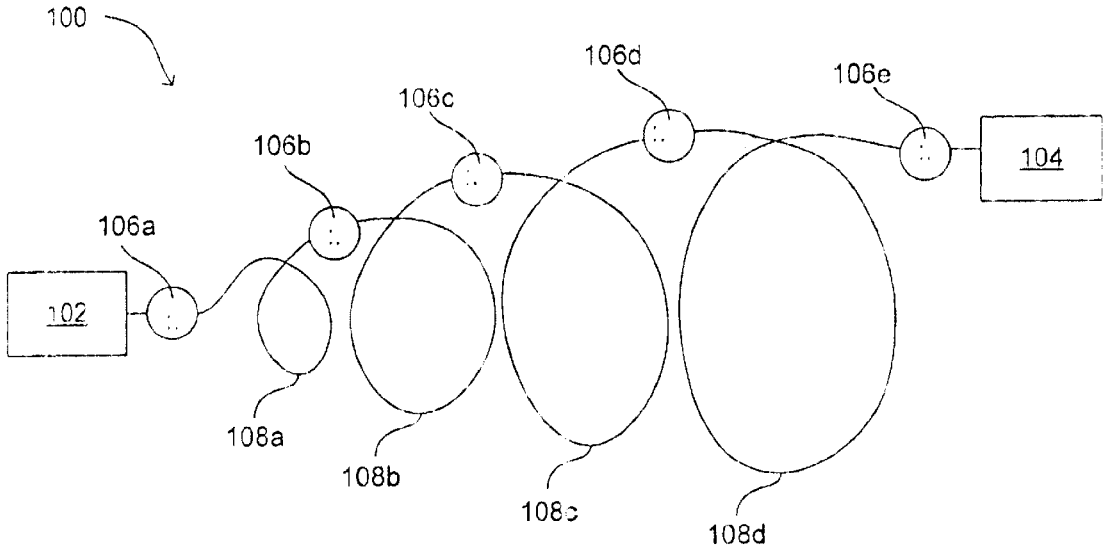
FIG. 6 is a spiral and conical spiral antenna system that is reconfigurable via a plurality of fluid filled bulbs.

In FIG. 6, a spiral or conical spiral system 100 is provided. A spiral antenna as well as a conical spiral antenna typically provide turns, similar to a helical antenna, except that the turns are not of a common diameter. With a spiral antenna, with each turn, the diameter of the turn increases. With a conical spiral antenna, with each turn, the diameter of the turn decreases.

With respect to spiral antennas in general, upon electromagnetic wave transmission where more turns are present, bandwidth increases and beam width is substantially unaffected. With a conical spiral antenna, a configuration is provides an arrangement wherein as more turns are present, the beam width is decreased and the bandwidth is increased.

System 100 can act as both a spiral antenna and a conical spiral antenna. When system 100 is acting as a spiral antenna, signal generator 102 communicates with the spiral antenna segments 108*a–d* through fluid filled bulbs 106*a–d*. When the fluid of fluid filled bulb 106*a* is energized to form a conductive plasma, spiral antenna segment 108*a* is effectively present for transmitting signal, i.e., one turn. When the fluid of fluid filled bulbs 106*a–b* are energized to form a conductive plasma, spiral antenna segments 108*a–b* are active for transmission, i.e., two turns. If the fluid of fluid filled bulbs 106*a–c* are all energized to form a conductive plasma, spiral antenna segments 108*a–c* are all active, i.e., three turns. If the fluid of fluid filled bulbs 106*a–d* are all energized to form a conductive plasma, spiral antenna segments 108*a–d* are all active, i.e., four turns.

In an alternative embodiment, system 100 can be utilized as a conical spiral antenna device. Specifically, when system 100 is acting as a conical spiral antenna, signal generator 104 communicates with the conical spiral antenna segments 108*a–d* through fluid filled bulbs 106*b–e*. When the fluid of fluid filled bulb 106*e* is energized to form a conductive plasma, conical spiral antenna segment 108*d* is effectively present for transmitting signal, i.e., one turn. When the fluid of fluid filled bulbs 106*d–e* are energized to form a conductive plasma, conical spiral antenna segments 108*c–d* are active for transmission, i.e., two turns. If the fluid of fluid filled bulbs 106*c–e* are all energized to form a conductive plasma, conical spiral antenna segments 108*b–d* are all active, i.e., three turns. If the fluid of fluid filled bulbs 106*b–e* are all energized to form a conductive plasma, spiral antenna segments 108*a–d* are all active, i.e., four turns.

Figure 7:
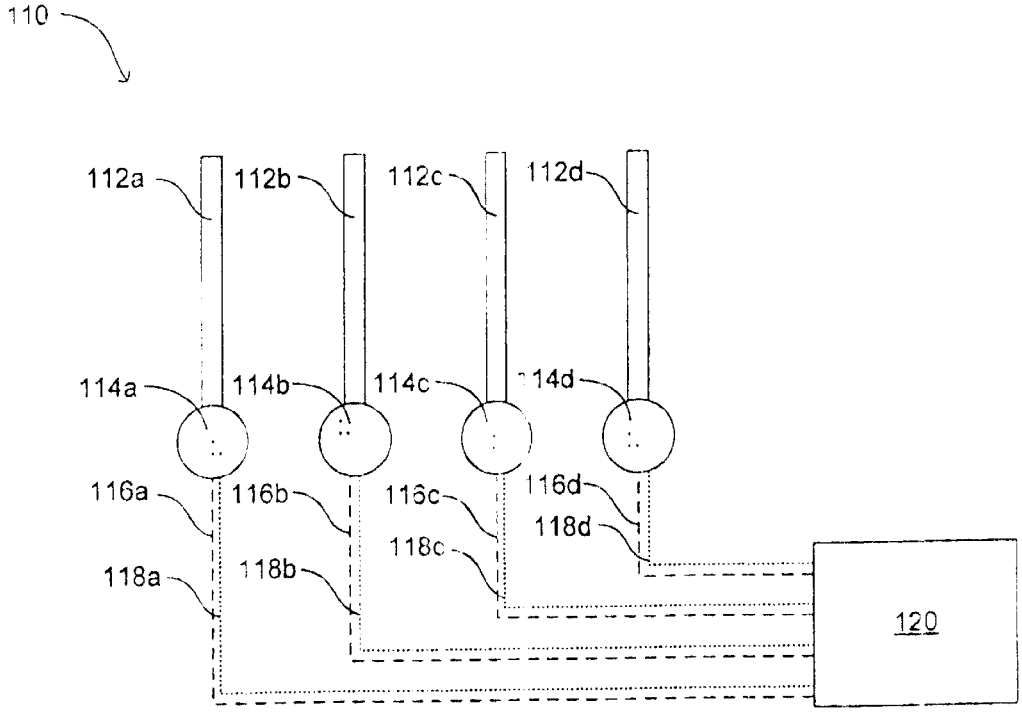
FIG. 7 is an antenna array system wherein fluid filled bulbs are provided to connect and disconnect individual antennas form a signal transmitter/receiver.

Turning to FIG. 7, an antenna array system 110 is provided wherein a plurality of antenna elements 112*a–d* are electromagnetically coupled to a power source and signal generator/signal receiver device 120 though a plurality of corresponding fluid filled bulbs 114*a–d*. Though the power source and signal generator/signal receiver device 120 is shown as a single device, each of these functions can be carried out by separate devices. Each fluid present in the fluid filled bulbs can individually be energized to form a plasma, thereby conducting electromagnetic signal between a corresponding antenna array element and the signal generator/signal receiver device 120. For example, if it is desired that all of the antenna elements of the array be utilized, then power source 120 can send current to fluid filled bulbs 114*a–d* through individual power couplers 116*a–d*, thereby energizing the fluid within the bulb to form a plasma. As a result, signal generator/signal receiver 120 can communicate with all of the antennas of the array through a plurality of signal couplers 118*a–d*. If any number less than all of the fluid filled bulbs are energized, e.g., 0, 1, 2, or 3, then the array will be reconfigured compared to an array wherein all of the bulbs are energized. To cite one specific example, one could energize the fluids within fluid filled bulbs 114*a* and 114*c* via its respective coupler 116 and the power source 120. Bulbs 114*b* and 114*d* can remain unenergized. Thus, antenna elements 112*a* and 112*c* are electromagnetically coupled to the signal generator/receiver 120 via their respective signal couplers 118, whereas antenna elements 112*b* and 112*d* are not.

In each of the above embodiments dealing with fluid filled bulbs, the antenna segments depicted are typically conductive wire or metal elements. However, other materials can be used as the conductive elements. For example, the conductive elements themselves can be plasma antenna elements or conductive fluid elements, e.g., conductive grease or liquid metal, etc. Additionally, with respect to each of the embodiments, when either transmitting or receiving of electromagnetic signal is mentioned, it is to be understood that both transmitting and receiving of signal can be carried out.

Though only a few examples of the use of fluid filled bulbs or tubes for use with known antenna device configurations have been provided, it is to be understood that other antenna structures can be modified using fluid filled bulbs in accordance with principles of the present invention. For example, metal antennas and plasma antennas including log-periodic antennas, yagi antennas, reflector antennas, aperture antennas, wire antennas of all varieties, dipole antennas, loop antennas, waveguides, lens antennas, bent antennas, discontinuous antennas, terminated antennas, truncated antennas, horn antennas, spiral antennas, conical spiral antennas, helical antennas, array antennas, traveling wave antennas, microstrip antennas, and the like, can benefit from the reconfigurability provided by strategic placement of fluid filled bulbs, wherein the fluid can be modified to form a conductive plasma.

While the invention has been described with reference to certain preferred embodiments, those skilled in the art will appreciate that various modifications, changes, omissions, and substitutions can be made without departing from the spirit of the invention.

What is claimed is:

1. An antenna, comprising:

(a) at least two conductive elements including a first conductive element having a different configuration than a second conductive element; and (b) a fluid filled bulb positioned between the at least two conductive elements such that when the fluid filled bulb is energized, the at least two conductive elements electrically communicate with one another, and when the fluid filled bulb is not energized, the at least two conductive elements do not electrically communicate with one another.

2. The antenna of claim 1, wherein at least one of the conductive elements has a linear configuration.

3. The antenna of claim 1, wherein one of the at least two conductive elements has a helical configuration.

4. The antenna of claim 1, wherein one of the at least two conductive elements has a spiral configuration.

5. The antenna of claim 1, wherein one of the at least two conductive elements has a conical configuration.

6. The antenna of claim 1, wherein one of the at least two conductive elements has a horn configuration.

7. The antenna of claim 1, wherein the first conductive element includes a linear configuration, and the second conductive element includes a configuration selected from the group consisting of helical, spiral, conical, horn and combinations thereof.

8. The antenna of claim 1, wherein the fluid filled bulb contains a fluid that can be energized to form a conductive plasma.

9. The antenna of claim 8, wherein the fluid is a gas.

10. The antenna of claim 9, wherein the gas is selected from the group consisting of argon, neon, helium, krypton, xenon, and hydrogen.

11. The antenna of claim 9, wherein the gas is a metal vapor.

12. The antenna of claim 11, wherein the metal vapor is mercury vapor.

13. The antenna of claim 1, wherein at least one of the at least two conductive elements is a plasma element.

14. The antenna of claim 1, wherein at least one of the at least two conductive elements is a metallic element.

15. An electromagnetic wave transmission and reception system, comprising:

(a) a first conductive element and a second conductive element;

(b) a transmitter/receiver for sending and receiving a signal to and from the first and second conductive elements;

(c) a first fluid filled bulb positioned between the first conductive element and the transmitter/receiver such that when the first fluid filled bulb is energized, the first conductive element and the transmitter/receiver electrically communicate with one another, and when the first fluid filled bulb is not energized, the first conductive element and the transmitter/receiver do not electrically communicate with one another; and (d) a second fluid filled bulb positioned between the second conductive element and the transmitter/receiver such that when the second fluid filled bulb is energized, the second conductive element and the transmitter/receiver electrically communicate with one another, and when the second fluid filled bulb is not energized, the second conductive element and the transmitter/receiver do not electrically communicate with one another.

16. The system of claim 15, wherein the first conductive element and the second conductive element are substantially electrically isolated from one another outside of the transmitter/receiver, wherein the first conductive element and the second conductive element are part of an antenna array.

17. The system of claim 15, wherein the first and second fluid filled bulbs contain a fluid that can be energized to form a conductive plasma.

18. The system of claim 17, wherein the fluid is a gas selected from the group consisting of argon, neon, helium, krypton, xenon, hydrogen, and mercury vapor.

19. An antenna, comprising:

(a) at least two conductive elements including a first conductive element and a second conductive element, wherein the first conductive element is configured to emit a first radiation pattern; and (b) a fluid filled bulb positioned between the at least two conductive elements such that when the fluid filled bulb is energized, the at least two conductive elements electrically communicate with one another and the at least two conductive elements work synergistically to form a second radiation pattern that is different than the first radiation pattern, and when the fluid filled bulb is not energized, the at least two conductive elements do not electrically communicate with one another.

20. The antenna of claim 19, wherein the first conductive element and the second conductive element are of substantially the same configuration.

* * * * *